US008404421B2

(12) United States Patent
Nakayama

(10) Patent No.: US 8,404,421 B2
(45) Date of Patent: Mar. 26, 2013

(54) TONER PARTICLE FOR LIQUID DEVELOPMENT AND METHOD FOR MANUFACTURING THE SAME, LIQUID DEVELOPER, LIQUID DEVELOPER CARTRIDGE, PROCESS CARTRIDGE, AND IMAGE-FORMING APPARATUS

(75) Inventor: Daisuke Nakayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 465 days.

(21) Appl. No.: 12/731,616

(22) Filed: Mar. 25, 2010

(65) Prior Publication Data

US 2011/0020748 A1 Jan. 27, 2011

(30) Foreign Application Priority Data

Jul. 22, 2009 (JP) ..... 2009-170983

(51) Int. Cl.
*G03G 9/00* (2006.01)

(52) U.S. Cl. ..... 430/114; 430/237

(58) Field of Classification Search ..... 430/114; 399/237

See application file for complete search history.

(56) References Cited

U.S. PATENT DOCUMENTS

2008/0311505 A1* 12/2008 Akioka ..... 430/114

FOREIGN PATENT DOCUMENTS

JP B2-5-87825 12/1993
JP A-2004-18671 1/2004

* cited by examiner

*Primary Examiner* — Mark A Chapman
(74) *Attorney, Agent, or Firm* — Oliff & Berridge, PLC

(57) ABSTRACT

A toner particle for liquid development is provided, the toner particle having a plurality of projections and a coat above at least a part of a surface of the toner particle, the toner particle further containing a crystal that forms at least one of the plurality of projections.

18 Claims, 1 Drawing Sheet

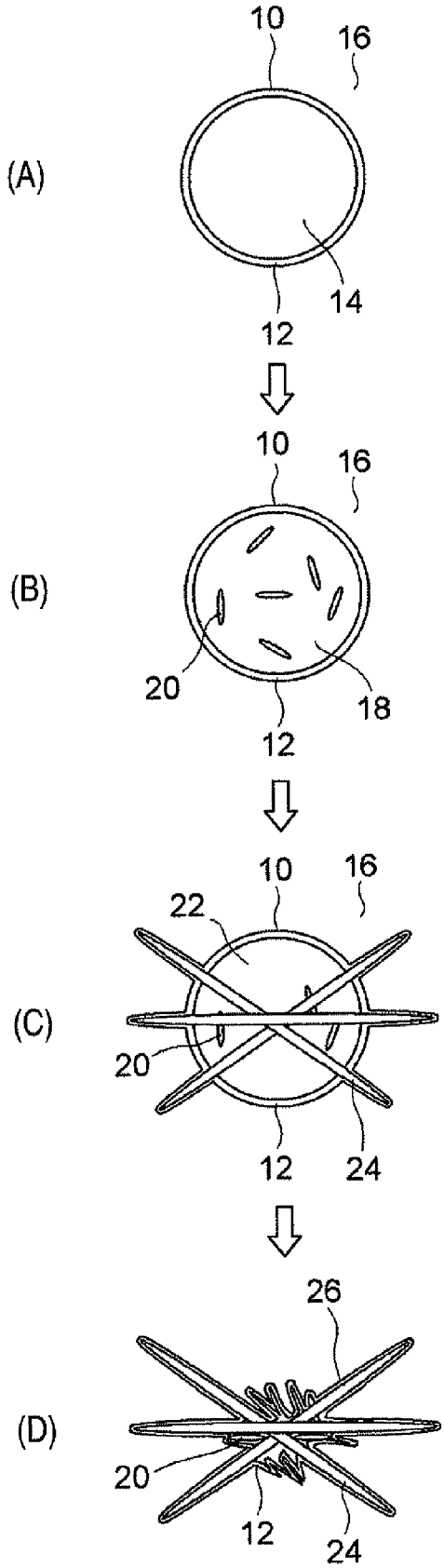
(A)
10
16
14
12
(B)
10
16
20
18
12
(C)
10
16
22
20
12
24
(D)
26
20
12
24

TONER PARTICLE FOR LIQUID DEVELOPMENT AND METHOD FOR MANUFACTURING THE SAME, LIQUID DEVELOPER, LIQUID DEVELOPER CARTRIDGE, PROCESS CARTRIDGE, AND IMAGE-FORMING APPARATUS

CROSS-REFERENCE TO RELATED APPLICATIONS

This application is based on and claims priority under 35 U.S.C. 119 from Japanese Patent Application No. 2009-170983 filed Jul. 22, 2009.

BACKGROUND

1. Technical Field

The present invention relates to a toner particle for liquid development and a method for manufacturing the same, a liquid developer, a liquid developer cartridge, a process cartridge, and an image-forming apparatus.

2. Related Art

The method for developing an electrostatic latent image in an electrophotographic process is broadly classified into a dry developing method and a wet developing method.

The dry developing method is a method of adhesion of a toner to an electrostatic latent image by using a powder toner. On the other hand, the wet developing method is a method of adhesion of a toner by using a liquid developer including a toner having been dispersed.

In recent years, needs for printing to be individually coped with on demand have increased, and application of an electrophotographic process not necessitating a printing plate is being discussed.

As conventional toners for liquid development for use in liquid developers, spherical or agglomerating particles obtained by dispersing a pigment singly or resin in which a pigment is dispersed in a liquid are known.

SUMMARY

According to an aspect of the present invention, there is provided a toner particle for liquid development, including a plurality of projections, the toner particle having a coat above at least a part of a surface of the toner particle and containing a crystal that forms at least one of the plurality of projections.

BRIEF DESCRIPTION OF THE DRAWINGS

Exemplary embodiment of the present invention will be described in detail based on the following figures, wherein:

FIGS. 1A to 1D are typical schematic drawings showing an example of the manufacturing method of the toner particle for liquid development of the exemplary embodiment in the case of using a self-assembled film.

DETAILED DESCRIPTION

The exemplary embodiment of the invention will be described in detail below.

In the exemplary embodiment, the description "A to B" means not only the range between A and B but also the range including both ends of A and B. For example, when "A to B" is the range of a numerical value and B is larger than A, "A to B" means "A or larger and B or smaller", and when B is smaller than A, which means "B or larger and A or smaller".

(Toner for Liquid Development)

A toner for liquid development in the exemplary embodiment (which is also referred to as "a liquid developing toner", "a toner for liquid development", or simply "a toner") includes particles (toner particles) each of which has plural projections, each particle has a coat on at least a part of the surface, and contains a crystal forming at least one of the projections.

The toner for liquid development of the exemplary embodiment includes particles having plural projections.

The number of the projections of the toner particle for liquid development of the exemplary embodiment is not especially restricted so long as the number is 2 or more, but it is preferred for the toner particle to have 3 or more projections.

As the size of the projections of the toner particle for liquid development of the exemplary embodiment, it is preferred that at least one projection in a toner particle has a length of 10% or more of the particle diameter, more preferred to have a length of 20% or more of the particle diameter, and still more preferred to have a length of 30% or more of the particle diameter.

The toner for liquid development of the exemplary embodiment has a coat on at least a part of the surface of the toner particle.

As the materials of the coat, self-assembled films and resins are exemplified.

It is sufficient for the toner for liquid development of the exemplary embodiment to have a coat on at least a part of the surface of the toner particle, and it is not necessary that the entire surface of the toner particle is covered with a coat. Further, the coat on the surface of the toner particle may have a hole, a rent, or flexure, for example, the coat may be pierced with the crystal.

The coat may be present not only on the surface of the particle but also inside.

It is preferred that 20% or about 20% or more of the surface area of the toner particle of the toner for liquid development of the exemplary embodiment is covered with a coat, more preferably 50% or more is covered with a coat, and still more preferably 80% or more is covered with a coat.

It is also preferred that the coat in the toner for liquid development of the exemplary embodiment is solid at an ordinary temperature (25° C.).

"A self-assembled film" for use in the exemplary embodiment means compounds and/or aggregates thereof capable of forming films such as a monomolecular film, an LB film and a double film having systems of constant orders formed by the physical properties of the film-forming components themselves in a state of not applying precise control from the outside.

The self-assembled film in the coat of the toner for liquid development of the exemplary embodiment is sufficient to be a film having an arbitrary shape, and it may be a monomolecular film or a bimolecular film, or may be a layered product of lamination of arbitrary two or more layers of these layers.

The materials of the self-assembled films for use in the exemplary embodiment are not especially restricted so long as they are capable of forming a monomolecular film or a bimolecular film, but the materials are preferably those capable of forming vesicle and liposome.

As the materials capable of forming vesicle and liposome, amphipathic materials such as phospholipids and surfactants are exemplified, and it is especially preferred to use phospholipids.

Phospholipids are amphipathic materials having groups of a hydrophobic group including long chain alkyl groups and a hydrophilic group including phosphoric acid groups in the molecule.

Both natural and synthetic phospholipids may be used in the exemplary embodiment so long as they are capable of forming liposome, and, for example, glycerophospholipid having glycerol as the skeleton and sphingophospholipid having sphingosine as the skeleton are exemplified.

As the glycerophospholipids, a phosphatidic acid, phosphatidyl glycerol, cardiolipin, phosphatidylcholine, phosphatidyl ethanolamine, phosphatidylserine, and phosphatidylinositol are specifically preferably exemplified.

As the sphingophospholipids, sphingomyelin, sphingo ethanolamine, and ceramide ciliatine are preferably exemplified.

As the fatty acids consisting of the phospholipids, saturated fatty acids having 10 to 25 carbon atoms, or unsaturated fatty acids may be preferably used. As the specific examples of such fatty acids, a palmitic acid and a stearic acid as the saturated fatty acids and an oleic acid as the unsaturated fatty acid are exemplified.

These materials of self-assembled films may be used alone, or two or more materials may be used as mixture.

The resins in the coat of the toner for liquid development of the exemplary embodiment are not especially restricted, but the binder resins of the toner are preferably exemplified.

As the resins for use as the coat, acrylic resins, styrene resins, vinyl resins, and addition polymerization resins of the copolymers of these resins, and polycondensation resins such as polyester resins and polyamide resins are exemplified.

Of these resins, addition polymerization resins are preferably used.

As the addition polymerizable monomers for use in the manufacture of addition polymerization resins, known monomers may be used. Further, resins may be complexes obtained by performing polycondensation and addition polymerization simultaneously or separately by using both of the polycondensation monomers and the addition polymerizable monomers.

As the addition polymerizable monomers, for example, cationic polymerizable monomers and radical polymerizable monomers are exemplified, but radical polymerizable monomers are preferred.

As the radical polymerizable monomers used in this case, the specific examples include vinyl aromatic compounds such as styrene, α-substituted styrenes, e.g., α-methylstyrene, α-ethylstyrene, etc., nucleus-substituted styrenes, e.g., m-methylstyrene, p-methylstyrene, 2,5-dimethylstyrene, etc., nucleus-substituted styrene halide, e.g., p-chlorostyrene, p-bromostyrene, dibromostyrene, etc., unsaturated carboxylic acids, e.g., a (meth) acrylic acid ("(meth)acrylic" means acrylic and methacrylic, hereinafter the same), a crotonic acid, a maleic acid, a fumaric acid, a citraconic acid, an itaconic acid, etc., unsaturated carboxylic esters, e.g., methyl (meth)acrylate, ethyl (meth)acrylate, propyl(meth)acrylate, butyl (meth)acrylate, pentyl(meth)acrylate, hexyl(meth) acrylate, 2-ethylhexyl(meth)acrylate, glycidyl(meth)acrylate, benzyl (meth)acrylate, etc., unsaturated carboxylic acid derivatives, e.g., (meth)acrylaldehyde, (meth) acrylonitrile, (meth)acrylamide, etc., N-vinyl compounds, e.g., N-vinylpyridine, N-vinylpyrrolidone, etc., vinyl esters, e.g., vinyl formate, vinyl acetate, vinyl propionate, etc., vinyl halide compounds, e.g., vinyl chloride, vinyl bromide, vinylidene chloride, etc., N-substituted unsaturated amides, e.g., N-methylolacrylamide, N-ethylol-acrylamide, N-propanolacrylamide, an N-methylolmaleinamic acid, N-methylolmaleinamate, N-methylolmaleimide, N-ethylolmaleimide, etc., conjugated dienes, e.g., butadiene, isoprene, etc., polyfunctional vinyl compounds, e.g., divinylbenzene, divinylnaphthalene, divinylcyclohexane, etc., and polyfunctional acrylates, e.g., ethylene glycol di(meth)acrylate, diethylene glycol di(meth)acrylate, propylene glycol di(meth)acrylate, tetramethylene glycol di(meth)acrylate, neopentyl glycol di(meth)acrylate, hexamethylene glycol di(meth)acrylate, trimethylolpropane di(meth)acrylate, trimethylolpropane tri (meth)acrylate, glycerol di(meth)acrylate, glycerol tri(meth) acrylate, pentaerythritol di(meth)acrylate, pentaerythritol tri (meth)acrylate, pentaerythritol tetra(meth)acrylate, dipentaerythritol di(meth)acrylate, dipentaerythritol tri (meth)acrylate, dipentaerythritol tetra(meth)acrylate, dipentaerythritol penta(meth)acrylate, dipentaerythritol hexa(meth)acrylate, sorbitol tri(meth)acrylate, sorbitol tetra(meth) acrylate, sorbitol penta(meth)acrylate, sorbitol hexa(meth) acrylate, etc. Of these radical polymerizable monomers, N-substituted unsaturated amides, conjugated dienes, polyfunctional vinyl compounds and polyfunctional acrylates may bring about crosslinking reaction to the formed polymers. These monomers may be used alone or in combination.

As the polymerization methods of the above addition polymerizable monomers, in particular radical polymerizable monomers, a method of using a radical polymerization initiator, a self polymerization method by heat, a method of using UV ray irradiation, and known polymerization methods may be used. As the method of using a radical polymerization initiator, there are oil-soluble and water-soluble initiators as the radical initiators and either may be used.

Specifically, the examples of the radical polymerization initiators include organic peroxides, such as azobis-nitriles, e.g., 2,2'-azobis(2-methylpropionitrile), 2,2'-azobis(2-methylpbutyronitrile), 2,2'-azobisisobutyronitrile, 2,2'-azobis(2,4-dimethylvaleronitrile), 2,2'-azobis(2,4-dimethyl-4-methoxyvaleronitrile), 1,1'-azobis(cyclohexane-carbonitrile), 2,2'-azobis(2-amidinopropane)hydrochloride, etc., diacyl peroxides, e.g., acetyl peroxide, octanoyl peroxide, 3,5,5-trimethylhexanoyl peroxide, decanoyl peroxide, lauroyl peroxide, benzoyl peroxide, etc., dialkyl peroxide, e.g., di-t-butyl peroxide, t-butyl-α-cumyl peroxide, dicumyl peroxide, etc., peroxy esters, e.g., t-butylperoxy acetate, α-cumylperoxy pivalate, t-butylperoxy octoate, t-butylperoxy neodecanoate, t-butylperoxylaurate, t-butylperoxy benzoate, di-t-butylperoxy phthalate, di-t-butylperoxy isophthalate, etc., hydroperoxide, e.g., t-butylhydroperoxide, 2,5-dimethylhexane-2,5-dihydro-peroxide, cumenehydroperoxide, diisopropylbenzenehydro-peroxide, etc., peroxycarbonates, e.g., t-butylperoxy-isopropylcarbonate, etc.; inorganic peroxides, such as hydrogen peroxide, etc.; persulfates, such as potassium persulfate, sodium persulfate, ammonium persulfate, etc.; and carbonyl polymerization initiators such as benzoyl ethers, benzyl dimethyl ketals, benzoyl benzoates, hydroxyl phenyl ketones, and aminophenyl ketones. Redox polymerization initiators may also be used.

Further, chain transfer agents may be used in addition polymerization. The chain transfer agents are not especially restricted, and specifically those having a covalent bond of a carbon atom and a sulfur atom are preferred, for example, thiols are preferably exemplified.

The toner particle of the toner for liquid development of the exemplary embodiment contains a crystal forming at least one of the projections.

At least one crystal contained inside the toner particle for liquid development of the exemplary embodiment forms at least one projection on the surface of the toner particle, and at least a crystal is present inside of at least one projection on the surface of the toner particle.

Further, "contain a crystal inside" means that the crystal is not necessary to be covered with a coat entirely and it is sufficient that the crystal is contained in the particle containing plural projections. For example, apart of the crystal may pierce the coat and come out of the surface of the coat.

Furthermore, it is sufficient for the toner particle for liquid development of the exemplary embodiment to have plural projections, and it is of course possible to have one or more projections not formed by a crystal.

Further, it is preferred that the toner for liquid development of the exemplary embodiment includes particles at least having two or more projections formed by one crystal.

The crystals are solid at ordinary temperature (25° C.) and not especially restricted so long as they are capable of forming projections on the surfaces of the toner particles, but needle crystals, plate crystals, columnar crystals, astral crystals, fibrous crystals, and polygonal crystals are preferred, needle crystals, columnar crystals, astral crystals and fibrous crystals are more preferred, and needle crystals are still more preferred.

Further, the crystals are preferably monocrystals.

In the toner for liquid development of the exemplary embodiment, out of the crystals contained in one toner particle, the maximum length of the longest crystal is preferably 20% or about 20% or more longer than the particle diameter of the toner particle, more preferably 50% or more longer, and still more preferably 70 to 100% longer.

Incidentally, "the maximum length of the crystal" in the exemplary embodiment is the maximum value at the time of connecting two points in the crystal by a straight line.

Further, in the toner for liquid development of the exemplary embodiment, out of the crystals contained in one toner particle, the aspect ratio of the crystal having the longest maximum length is preferably 5 or about 5 or more, more preferably 10 or more, and preferably 200 or about 200 or less.

"The aspect ratio of the crystal" in the exemplary embodiment is the ratio of the lengths on two axes of X, Y and Z axes of the crystal.

The measuring methods of the maximum length and the aspect ratio of crystals are not especially restricted and these may be measured according to known methods. For example, these are measured by observation or image treatment in the pickup image or the projected image of the particle and crystal obtained with an optical microscope or an image pickup apparatus.

The preferred examples of the materials of the crystals for use in the toner for liquid development of the exemplary embodiment include coloring agents, e.g., chrome yellow, Cyanine Blue, phthalocyanine derivative, Quinacrine Red derivative, Oxazine Violet, Lake Red, carmine, anthraquinone derivative, etc., amino acids, e.g., glycine, alanine, valine, leucine, isoleucine, serine, a glutamic acid, an aspartic acid, glutamine, etc., a salicylic acid derivative, tyrosine, lysozyme, menthol, an oxalic acid derivative, zinc oxide, silicon, sulfur, a benzoic acid, potassium nitrate, potassium sulfate, a lauric acid, etc. Of these materials, chrome yellow, Lake Red and tyrosine are especially preferred.

The crystals for use in the toner for liquid development of the exemplary embodiment may be crystals having only the function of forming projections, or may be those having the function as coloring agents besides the function of forming projections as above.

The toner for liquid development of the exemplary embodiment may contain, if necessary, known toner components such as a binder resin, a coloring agent, and a releasing agent besides a coat and a crystal.

The toner for liquid development of the exemplary embodiment may contain a binder resin.

The binder resins are not especially restricted so long as they are resins used in colored resin particles (toner particles) of a liquid developer, and addition polymerization resins, e.g., acryl-based resins, styrene-based resins, vinyl-based resins, copolymers of these resins, etc., and polycondensation resins, e.g., polyester resins, polyamide resins, etc., are exemplified.

The polyester resins for use in the exemplary embodiment (hereinafter also referred to as merely "polyester" in some cases) are obtained by polycondensation of at least one of a polycondensable monomer and the oligomer, or prepolymer thereof, but polyester resins obtained by polycondensation of a polyvalent carboxylic acid and polyol are preferred.

As the polycondensable monomers, e.g., a polyvalent carboxylic acid, polyol, a hydroxycarboxylic acid, and mixtures of these monomers are exemplified, and it is preferred to sue at least a polyvalent carboxylic acid and polyol. In particular, as the polycondensable monomers, a polyvalent carboxylic acid and polyol, and further, ester compounds thereof (at least one of an oligomer and prepolymer) are preferred, and monomers capable of obtaining polyester by direct ester reaction or through ester exchange reaction are preferred. In this case, polyester resins to be polymerized may take any form of an amorphous polyester resin (a non-crystalline polyester resin) and a crystalline polyester resin, or mixture of these resins.

Polyvalent carboxylic acids are compounds having two or more carboxyl groups in one molecule. Of polyvalent carboxylic acids, a dicarboxylic acid is a compound having two carboxyl groups in one molecule, and the examples of dicarboxylic acids include an oxalic acid, a succinic acid, a fumaric acid, a maleic acid, an adipic acid, a β-methyladipic acid, a malonic acid, a pimelic acid, an azelaic acid, a sebacic acid, a nonanedicarboxylic acid, a decanedicarboxylic acid, an undecanedicarboxylic acid, a dodecanedicarboxylic acid, a citraconic acid, a cyclohexane-3,5-diene-1,2-carboxylic acid, a hexahydroterephthalic acid, a phthalic acid, an isophthalic acid, a terephthalic acid, a tetrachlorophthalic acid, a chlorophthalic acid, a nitrophthalic acid, a p-carboxyphenyl-acetic acid, a p-phenylenedipropionic acid, an m-phenylenedipropionic acid, an m-phenylenediacetic acid, a p-phenylene-diacetic acid, an o-phenylenediacetic acid, a diphenyl-diacetic acid, a diphenyl-p,p'-dicarboxylic acid, a 1,1-cyclopentenedicarboxylic acid, a 1,4-cyclohexane-dicarboxylic acid, a 1,3-cyclohexanedicarboxylic acid, a 1,2-cyclohexanedicarboxylic acid, a 1,2-cyclohexene-dicarboxylic acid, a norbornene-2,3-dicarboxylic acid, a 1,3-adamantanedicarboxylic acid, a 1,3-adamantanediacetic acid, a naphthalene-1,4-dicarboxylic acid, a naphthalene-1,5-dicarboxylic acid, a naphthalene-2,6-dicarboxylic acid, an anthracenedicarboxylic acid, etc.

As the examples of polyvalent carboxylic acids other than dicarboxylic acids, e.g., a trimellitic acid, a pyromellitic acid, a naphthalenetricarboxylic acid, a naphthalenetetra-carboxylic acid, a pyrenetricarboxylic acid, a pyrene-tetracarboxylic acid, etc., are exemplified.

The above carboxylic acids may have functional groups other than carboxyl groups, and carboxylic acid derivatives such as acid anhydrides and acid esters may also be used.

Preferably used monomers among these polyvalent carboxylic acids are a sebacic acid, a nonanedicarboxylic acid, a decanedicarboxylic acid, an undecanedicarboxylic acid, a dodecanedicarboxylic acid, a p-phenylenediacetic acid, an m-phenylenediacetic acid, a p-phenylenedipropionic acid, an m-phenylenedipropionic acid, a 1,4-cyclohexanedicarboxylic acid, a 1,3-cyclohexanedicarboxylic acid, a naphthalene-1,4-dicarboxylic acid, a naphthalene-1,5-dicarboxylic acid, a naphthalene-2,6-dicarboxylic acid, a trimellitic acid, and a pyromellitic acid.

Further, as polyvalent carboxylic acids other than dicarboxylic acids, a trimellitic acid, a pyromellitic acid, a naphthalenetricarboxylic acid, a naphthalenetetra-carboxylic acid, a pyrenetricarboxylic acid, a pyrene-tetracarboxylic acid, etc., are exemplified. In addition, lower esters of these polyvalent carboxylic acids are exemplified, and acid chlorides of these polyvalent carboxylic acids are also exemplified.

These monomers may be used by one kind alone or two or more kinds may be used in combination.

The lower ester means that the number of carbon atoms of the alkoxy portion of the ester is 1 or more and 8 or less. Specifically, methyl ester, ethyl ester, n-propyl ester, isopropyl ester, n-butyl ester, isobutyl, etc., are exemplified.

Polyols are compounds having two or more hydroxyl groups in one molecule. Polyols are not especially restricted and the following monomers are exemplified.

Diols are compounds having two hydroxyl groups in one molecule, and propanediol, butanediol, pentanedial, hexanediol, heptanediol, octanediol, nonanediol, decanediol, dodecanediol, tetradecanediol, octadecanediol, etc., are exemplified.

As polyols other than the dials, glycol, pentaerythritol, hexamethylolmelamine, hexaethylolmelamine, tetramethylol-benzoguanamine, tetraethylolbenzoguanamine are exemplified.

As polyols having a cyclic structure, the following monomers are exemplified. For example, cyclohexanediol, cyclohexanedimethanol, bisphenol A, bisphenol C, bisphenol E, bisphenol F, bisphenol P, bisphenol S, bisphenol Z, hydrogenated bisphenol, biphenol, naphthalenediol, 1,3-adamantanediol, 1,3-adamantanedimethanol, 1,3-adamantanediethanol, etc., are exemplified.

In the exemplary embodiment, it is preferred for the above bisphenols to have at least one alkylene oxide group. As the alkylene oxide groups, an ethylene oxide group, a propylene oxide group, a butylenes oxide group, etc., are exemplified. An ethylene oxide group and a propylene oxide group are preferably exemplified, and the addition mol number is preferably 1 or more and 3 or less. When the addition mol number is in this range, the viscoelasticity and glass transition temperature of the polyester to be manufactured are pertinently controlled for use as a liquid developer.

Of the above monomers, hexanediol, cyclohexanediol, octadecanediol, decanediol, dodecanediol, and the alkylene oxide adduct of each of bisphenol A, bisphenol C, bisphenol E, bisphenol S and bisphenol Z are preferably used.

Polycondensation monomers may be used as mixture of two or more kinds in an arbitrary proportion. Further, noncrystalline resins and crystalline resins may be easily obtained by the combination of polycondensation monomers.

For example, as the polyvalent carboxylic acids used to obtain crystalline polyester, an oxalic acid, a malonic acid, a succinic acid, a glutaric acid, an adipic acid, a pimelic acid, a suberic acid, an azelaic acid, a sebacic acid, a maleic acid, a fumaric acid, a citraconic acid, an itaconic acid, a glutaconic acid, an n-dodecylsuccinic acid, an n-dodecenyl-succinic acid, an isododecylsuccinic acid, an isododecenyl-succinic acid, an n-octylsuccinic acid, an n-octenylsuccinic acid, and acid anhydrides of these acids and lower esters of these acids are exemplified. Acid chlorides are also exemplified.

As the polyols usable to obtain crystalline polyesters, ethylene glycol, diethylene glycol, triethylene glycol, 1,2-propanediol, 1,3-propanediol, 1,4-butanediol, 1,4-butenediol, neopentyl glycol, 1,5-pentanediol, 1,6-hexanediol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A, etc., are also exemplified.

Further, as the polyvalent carboxylic acids usable to obtain noncrystalline polyesters, aromatic dicarboxylic acids, such as dibasic acids, e.g., a phthalic acid, an isophthalic acid, a terephthalic acid, a naphthalene-2,6-dicarboxylic acid, a malonic acid, a mesaconic acid, etc., and lower esters thereof are exemplified. As trivalent or higher carboxylic acids, e.g., a 1,2,4-benzenetricarboxylic acid, a 1,3,5-benzenetricarboxylic acid, 1,2,4-naphthalenetricarboxylic acid, and anhydrides thereof, sodium 2-sulfoterephthalate, sodium 5-sulfoisophthalate, sodium sulfosuccinate, and lower esters thereof are exemplified.

As such crystalline polyesters, polyester obtained by reaction of 1,9-nonanediol and 1,10-decanedicarboxylic acid, or polyester obtained by reaction of cyclohexanediol and adipic acid, polyester obtained by reaction of 1,6-hexanediol and sebacic acid, polyester obtained by reaction of ethylene glycol and succinic acid, polyester obtained by reaction of ethylene glycol and sebacic acid, and polyester obtained by reaction of 1,4-butanediol and succinic acid are exemplified. Of these polyesters, polyesters obtained by reaction of 1,9-nonanediol and 1,10-decanedicarboxylic acid and 1,6-hexanediol and sebacic acid are especially preferred.

Crystalline melting temperature Tm in the case where the polycondensation resin is a crystalline resin is preferably 50° C. or higher and 120° C. or lower, and more preferably in the range of 55° C. or higher and 110° C. or lower. When Tm is 50° C. or higher, cohesive force of the binder resin itself is good in a high temperature region, so that excellent peeling property and hot offset property are obtained in fixation. While when Tm is 120° C. or lower, sufficient melting is obtained and the minimum fixing temperature is not liable to rise.

On the other hand, when the polycondensation resin is a noncrystalline resin, glass transition temperature Tg is preferably 50° C. or higher and 80° C. or lower, and more preferably in the range of 50° C. or higher and 70° C. or lower. When Tg is 50° C. or higher, cohesive force of the binder resin itself is good in a high temperature region, so that excellent hot offset property is secured in fixation. While when Tg is 80° C. or lower, sufficient melting is obtained and the minimum fixing temperature is not liable to rise.

In the measurement of the melting temperature of a crystalline resin, a differential scanning calorimeter (DSC) is used. The temperature is obtained as the melting peak temperature of input compensatory differential scanning heating value measurement shown in JIS K-7121 87 at the time of the measuring temperature from room temperature to 150° C. at temperature rising rate of 10° C. every minute. In a crystalline resin, there are cases where two or more melting peaks are shown, and the maximum peak is taken as the melting temperature in the exemplary embodiment.

The glass transition temperature of a noncrystalline resin is the value measured according to the method defined in ASTM D3418-82 (the DSC method).

Incidentally, "crystalline" as shown in the above "crystalline polyester" shows to have a clear endothermic peak not stepwise endothermic change in the differential scanning heating value measurement (DSC), specifically it means that the half value width of the endothermic peak measured at temperature rising rate of 10° C./min is not exceeding 6° C.

On the other hand, resins having the half value width of the endothermic peak exceeding 6° C. and resins in which a clear endothermic peak is not observed mean to be noncrystalline (amorphous).

As polyhydric alcohols usable to obtain noncrystalline polyesters, aliphatic, alicyclic and aromatic polyhydric alcohols, and specifically, 1,5-pentanedial, 1,6-hexanediol, 1,4-cyclohexanediol, 1,4-cyclohexanedimethanol, dipropylene glycol, polyethylene glycol, polypropylene glycol, polytetramethylene glycol, bisphenol A, bisphenol Z, hydrogenated bisphenol A, etc., are preferably exemplified.

Further, polycondensation may be performed by using a hydroxylcarboxylic acid compound having a carboxylic acid and a hydroxyl group in one molecule. For example, a hydroxyl-octanoic acid, a hydroxynonanoic acid, a hydroxydecanoic acid, a hydroxyundecanoic acid, a hydroxydodecanoic acid, a hydroxytetradecanoic acid, a hydroxyltridecanoic acid, a hydroxyhexadecanoic acid, a hydroxypentadecanoic acid, a hydroxystearic acid, a tartaric acid, a malic acid, a citric acid, a mucic acid, etc., are exemplified as such hydroxylcarboxylic acid compounds.

The weight average molecular weight of the polyester resins is preferably 1,500 or more and 55,000 or less, and more preferably 3,000 or more and 45,000 or less. When the weight average molecular weight is 1,500 or more, cohesive force of the binder resin is good and excellent in hot offset property, while when it is 55,000 or less, excellent offset property is ensured and the minimum fixing temperature shows superior value. Further, these may be partially-branched or crosslinked by selecting a carboxylic acid valence or an alcoholic valence of a monomer.

The manufacturing method of a polycondensation resin is not especially restricted and known methods may be used. For example, it is preferred to polycondensate polycondensation monomer in the presence of polycondensation catalysts.

Known polycondensation catalysts may be used, for example, acid catalysts, e.g., Brϕnsted acids and Lewis acids, and metallic catalysts, e.g., zinc compounds are exemplified.

As addition polymerization resins usable as binder resins, the resins described above usable in the coat are preferably used.

The weight average molecular weight of the addition polymerization resins is preferably 5,000 to 50,000, and more preferably 7,000 to 35,000. When the weight average molecular weight is 5,000 or more, powder flowability at ordinary temperature is good and blocking does not occur, and so preferred, further, cohesive force of the binder resin is good and reduction of hot offset property does not occur. While when it is 50,000 or less, good offset property and good minimum fixing temperature are obtained, in addition, appropriate time and temperature required in polycondensation are secured and manufacturing efficiency rises.

Incidentally, the weight average molecular weight of the addition polymerization resins can be measured according to gel permeation chromatography (GPC) and the like.

The content of the binder resin in the toner for liquid development of the exemplary embodiment is not especially restricted but is preferably 20 to 95% by weight based on the total weight of the toner, and more preferably 30 to 90% by weight.

It is preferred for the toner for liquid development of the exemplary embodiment to contain a coloring agent. Further, the coloring agent may be contained in the toner as the crystal forming projections.

The coloring agents are not especially restricted and known coloring agents may be used.

The examples of the coloring agents include various kinds of pigments, e.g., carbon black, chrome yellow, Hansa Yellow, Benzidine Yellow, Indanthrene Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengale, Aniline Blue, Ultramarine Blue, Chalco Oil Blue, Methylene Blue Chloride, Phthalocyanine Blue, Phthalocyanine Green, Malachite Green Oxalate, titanium black, etc., and various kinds of dyes, e.g., acridine-based, xanthene-based, azo-based, benzoquinone-based, azine-based, anthraquinone-based, dioxazine-based, thiazine-based, azomethine-based, indigo-based, thioindigo-based, phthalocyanine-based, aniline black-based, polymethine-based, triphenylmethane-based, diphenylmethane-based, thiazole-based, etc. As the coloring agents, carbon black, Nigrosine dye (C.I. No. 50415B, Aniline Blue (C.I. No. 50405), Chalco Oil Blue (C.I. No. Azoic Blue 3), chrome yellow (C.I. No. 14090), Ultramarine Blue (C.I. No. 77103), Du Pont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengale (C.I. No. 45435), and mixture of these coloring agents may be specifically preferably used.

The content of the coloring agents other than the crystals is preferably 0.1 to 20% by weight based on the total weight of the toner, and especially preferably 0.5 to 10% by weight. As the coloring agents these pigments and dyes may be used alone or two or more kinds in combination.

These coloring agents may be dispersed according to arbitrary methods, for example, by dispersing methods using a rotary shearing type homogenizer, and a ball mill, sand mill and Dyno-Mill, each having media, with no limitation. These coloring agent particles may be added to a mixed solvent with other particle components at one time, or may be added dividedly according to multistage addition.

The toner for liquid development of the exemplary embodiment and/or the liquid developer of the exemplary embodiment may contain a dispersant and a pigment derivative.

The dispersant is not especially restricted and either a low molecular weight or high molecular weight dispersant may be used, but a polymer dispersant is preferably used.

As the examples of polymeric dispersants, polyester acid amide-amine salt (as a commercially available product, DISPARLON DA-725, manufactured by Kusumoto Chemicals, Ltd.), a reaction product of a polyamine compound and a hydroxyl aliphatic self condensing material (as commercially available products, SOLSPERSE 11200, SOLSPERSE 13940, SOLSPERSE 17000, and SOLSPERSE 18000, manufactured by Lubrizol Advanced Materials Inc.), polyvinyl alcohol, carboxymethyl cellulose, polyethylene glycol, polycarboxylic acid and salts thereof, polyacrylic acid metal salts (e.g., sodium salts, etc.), polymethacrylic acid metal salts (e.g., sodium salts, etc.), polymaleic acid metal salts (e.g., sodium salts, etc.), acrylic acid-maleic acid copolymer metal salts (e.g., sodium salts, etc.), polystyrenesulfonic acid metal salts (e.g., sodium salts, etc.), ammonium salts, etc., are exemplified.

As the pigment derivatives, derivatives of known pigments may be used, which may be different in structures from the coloring agents.

As the pigment derivatives, pigment derivatives including pigments bonded to polymeric materials may also be used.

As the pigment derivatives, (SOLSPERSE 5000 and SOLSPERSE 22000, manufactured by Lubrizol Advanced Materials Inc.) are exemplified.

The toner for liquid development of the exemplary embodiment may contain, if necessary, a charge controlling agent, and any compound ordinarily used in liquid developers may be used.

As the charge controlling agents, compounds selected from the group consisting of metal salts of benzoic acid, metal salts of salicylic acid, metal salts of alkylsalicylic acid, metal salts of catechol, metal-containing bisazo dyes, tetraphenyl borate derivatives, quaternary ammonium salts, and alkylpyridinium salts, and those obtained by combination of two or more of these compounds are preferably used.

The addition amount of these charge controlling agents is preferably 0.1 to 10% by weight based on the total weight of the toner, and more preferably 0.5 to 8% by weight. When the amount is 0.1% by weight or more, sufficient charge controlling effect is obtained, and when the amount is 10% by weight or less, excessive increase of electric conductivity of the liquid developer is restrained.

Further, metal soaps and inorganic or organic metal salts may be used in combination with the charge controlling agent. As such metal soaps, aluminum tristearate, aluminum distearate, barium stearate, calcium stearate, lead stearate, zinc stearaate, cobalt linolenate, manganese linolenate, lead linolenate, zinc linolenate, aluminum octanoate, calcium octanoate, cobalt octanoate, calcium oleate, cobalt oleate, zinc palmitate, calcium naphthenate, cobalt naphthenate, manganese naphthenate, lead naphthenate, zinc naphthenate, calcium resinate, cobalt resinate, manganese resinate, lead resinate, zinc resinate, etc., are exemplified. Metal soaps have also a charge controlling property, which is useful from the viewpoint of the dispersibility of colored resin particles. Further, as the inorganic and organic metal salts, for example, cationic components in the metal salts are selected from the group consisting of the metals belonging to Group I, Group II and Group XIII of the Periodic Table (IUPAC, Inorganic Chemistry Nomenclature, Revised Edition, 1989), and they are salts selected from the group consisting of halides, carbonates, acetates, sulfates, borates, nitrates, and phosphates of these metals.

Further, the toner for liquid development of the exemplary embodiment may be blended with auxiliaries, e.g., wax, and any wax ordinarily used in liquid developers may be used.

As waxes, e.g., paraffin wax, polyethylene wax, polypropylene wax, ethylene copolymer, propylene copolymer, etc., are exemplified.

The auxiliaries such as charge controlling agents and waxes may also be used by blending into the binder resins containing the coloring agents.

The volume average particle diameter of the toner for liquid development of the exemplary embodiment is preferably 0.1 to 6 μm, and more preferably 0.5 to 4 μm.

In the measurement of the average particle diameter of the particles such as the toner particle for liquid development of the exemplary embodiment, it is preferred to use COULTER COUNTER Model TA-II (manufactured by Beckman-Coulter Inc.). In this case, the measurement is performed with optimal aperture according to the particle diameter level of the particles. The particle diameter of the particles measured is expressed as a volume average particle diameter.

Further, when the particle diameter of particles is about 5 μm or less, measurement is preferably performed with a laser diffraction scattering type particle size distribution measuring instrument (LA-700, manufactured by Horiba Seisakusho Co., Ltd.).

Further, when the particle diameter is in nanometer order, it is preferred to perform measurement with a BET type specific surface area measuring instrument (FLOW SORB 112300, manufactured by Shimadzu Corporation).

(The Manufacturing Method of the Toner for Liquid Development)

It is preferred for the manufacturing method of the toner for liquid development of the exemplary embodiment to contain a dispersing process that manufactures a dispersion having dispersed therein particles formed by a coat containing the material for a crystal inside, and a forming process that forms crystal having a maximum length longer than the particle diameter of the particle by applying external stimulation in the particle.

<Dispersing Process>

It is preferred for the manufacturing method of the toner for liquid development of the exemplary embodiment to contain a dispersing process that manufactures a dispersion having dispersed therein particles formed by a coat containing the material for a crystal inside.

In the dispersing process, by dissolving the material for the crystal and the material for the coat in a dispersion medium, particles formed by the coat are formed in the dispersion medium, by which the particles are formed in the state of containing the material for a crystal dissolved in the dispersion medium. Further, the material for a crystal in the dispersing process may be completely dissolved in the dispersion medium, or the material may be partly dissolved and partly dispersed as micro particles.

As the materials for crystal, the materials for crystal described in the toner for liquid development of the exemplary embodiment are preferably used, and preferred embodiments are also the same.

"The materials for crystals" include not only the materials for crystals dissolved, or dissolved and dispersed, in a dispersion medium but also one or more compounds forming crystal by chemical changes such as reaction and decomposition.

Also, the material for a crystal in a dispersion medium in the dispersing process is preferably in the state of dissolution or in the state of dispersion as particles having the longest lengths shorter than the particle diameters of particles formed by a coat.

The dispersion media for use in the dispersing process are not especially restricted so long as they are solvents capable of dissolving the material for a crystal and the material for a coat, but preferably they are solvents capable of easily forming the crystal by external stimulation such as the change in temperature in the forming process.

The dispersion media usable in the exemplary embodiment may also be water or aqueous solvents such as alcohols or may be organic solvents.

As the aqueous media usable in the exemplary embodiment, water such as distilled water and ion exchange water, and alcohols such as ethanol and methanol are exemplified. Of these media, ethanol and water are preferred, and water such as distilled water and ion exchange water are especially preferred. The media may be used alone or two or more kinds of media may be used in combination.

Further, the aqueous solvents may contain water-miscible organic solvents. As the water-miscible organic solvents, acetone and acetic acid are exemplified, for example.

As the specific examples of the organic solvents usable in the exemplary embodiment, hydrocarbon solvents, e.g., toluene, xylene, mesitylene, etc., halogen solvents, e.g., chlorobenzene, bromobenzene, iodobenzene, dichlorobenzene, 1,1,2,2-tetrachloroethane, p-chlorotoluene, etc., ketone solvents, e.g., 3-hexanone, acetophenone, benzophenone, etc., ether solvents, e.g., dibutyl ether, anisole, phenetole, o-dimethoxybenzene, p-dimethoxybenzene, 3-methoxytoluene, dibenzyl ether, benzyl phenyl ether, methoxynaphthalene, tetrahydrofuran, etc., thioether solvents, e.g., phenyl sulfide, thioanisole, etc., ester solvents, e.g., ethyl acetate, butyl acetate, pentyl acetate, methyl benzoate, methyl phthalate, ethyl phthalate, cellosolve acetate, etc., and diphenyl ether solvents, such as diphenyl ether, alkyl-substituted diphenyl ether, e.g., 4-methylphenyl ether, 3-methylphenyl ether, 3-phenoxytoluene, etc., halogen-substituted diphenyl ether, e.g., 4-bromophenyl ether, 4-chlorophenyl ether, 4-bromodiphenyl ether, 4-methyl-4'-bromodiphenyl ether, etc., alkoxy-substituted diphenyl ether, e.g., 4-methoxydiphenyl ether, 4-methoxyphenyl ether, 3-methoxyphenyl ether, 4-methyl-4'-methoxydiphenyl ether, etc., and cyclic diphenyl ethers, e.g., dibenzofuran, xanthenes, etc., are exemplified. These organic solvents may be used alone or two or more kinds of solvents may be used in combination.

The concentration of the material for the crystal in the dispersion is not especially restricted, but a solution or a super-saturated solution of saturation concentration of 80 to 100% is preferred, and a solution or a super-saturated solution of saturation concentration of 95 to 100% is more preferred. When the concentration is in the above range, the crystals are easily formed in the forming process.

Further, in the dispersing process, it is preferred to maintain the temperature of the dispersion medium at 40 to 120° C. so as not to precipitate the crystals outside the particles, and it is more preferred to maintain the temperature at 60 to 100° C. It is also preferred to maintain the temperature of the dispersion medium in the dispersing process at almost constant (e.g., in the range of ±5° C.).

In the dispersing process, in the case of forming a self-assembled film with the material for the self-assembled film, dispersion is made by mixing the material for a crystal, the material for a coat and a dispersion medium, which dispersion includes the dispersion medium having dispersed therein the particles formed by the coat containing the material for the crystal inside.

Further, in the dispersing process in the case of forming the self-assembled film, after mixing the material for a crystal, the material for a coat and the dispersion medium, it is preferred to leave the mixed dispersion medium as it stands for the purpose of accelerating the formation of the particles formed by the coat.

In the dispersing process, in the case of forming the coat with a resin, by performing a process of forming dispersion including water having dispersed therein oil droplets containing water inside (W/O/W emulsion dispersion), and a process of curing the resin component of the oil phase portion in the W/O/W emulsion dispersion, dispersion including the dispersion medium having dispersed therein the particles formed by the coat containing the material for the crystal inside is made.

The W/O/W emulsion dispersion is formed by manufacturing, in the first place, dispersion of water droplets in oil (W/O emulsion dispersion), and dispersing the above dispersion further in water. It is preferred to use a two liquid mixture type micro-reactor in the above dispersion.

As the aqueous phase components in the oil droplets of the W/O/W emulsion dispersion, the aqueous media containing the dissolved materials of crystals are exemplified and the preferred embodiments are also the same. It is also preferred for the aqueous media to contain a surfactant.

As the surfactants, a wide range of anionic, cationic and nonionic surfactants are used. Anionic and nonionic surfactants are generally preferred. Anionic and cationic surfactants are characterized in that generally they have respectively one or more ionic (anionic or cationic) groups and hydrophobic groups. Preferred anionic groups are a carboxylic acid group and a sulfonic acid group. Preferred cationic groups are an ammonium group and a phosphonium group. Hydrophobic groups are preferably an aromatic group having 6 or more carbon atoms, an aliphatic group having 6 or more carbon atoms, and a combination of an aromatic group and an aliphatic group having 6 to 30 carbon atoms in total, and more preferably an aliphatic group having 8 to 30 carbon atoms, and a combination of an aromatic group and an aliphatic group having 6 to 30 carbon atoms in total.

Preferred anionic and cationic surfactants contain at least one acyclic alkyl or alkenyl group having 6 or more carbon atoms. Further, the anionic and cationic surfactants may contain other portion containing at least one of an oxyethylene group and an oxypropylene group, such as an oxyalkylene group.

As the preferred examples of the anionic and cationic surfactants, sodium laurylsulfate, straight chain dodecylbenzenesulfonate, triethanolamine laurylsulfate, sodium dodecyl diphenyl oxide disulfonate, sodium n-decyl diphenyl oxide disulfonate, sodium hexyl diphenyl oxide disulfonate, dodecylbenzenesulfonate, sodium stearate, ammonium, sodium abietate, etc., are exemplified.

As commercially available products of these kinds of surfactants, POLYSTEP A-15 (trade mark), and BISFOT S-100 (trade mark) (manufactured by Stepan Chemical Co.), DESULF TLS-40 (trade mark) (manufactured by Deforest), DOWFAX 2A1, 3B2 and C6L (trade marks) (manufactured by The Dow Chemical Company), EMKAPOL PO-18 (trade mark) (manufactured by Emkay), DRESINATE TX (trade mark) (manufactured by Hercules), and TRITON X-100, X-405 and X-165 (trade marks) (manufactured by Union Carbide) are exemplified.

It is preferred for the oil phase components of W/O/W emulsion dispersion to contain an addition polymerizable monomer and a polymerization initiator, or a resin and an organic solvent, and it is more preferred to contain an addition polymerizable monomer and a polymerization initiator.

As the addition polymerizable monomers and polymerization initiators, those described above in the binder resin are preferably used.

Further, the resins are not especially restricted but those usable as the binder resin of the toner are preferred, and the above-described binder resins are preferably used.

The organic solvents as described above in the dispersion medium are preferably used.

The aqueous phase component on the outside of the oil droplet in the W/O/W emulsion dispersion is not especially restricted and the above-described aqueous media are exemplified, and it is preferred to contain a surfactant, such as those exemplified above.

When an addition polymerizable monomer and a polymerization initiator are contained as the oil phase components, the resin component in the oil phase portion is cured by polymerization of the addition polymerizable monomer in the oil phase components with light and heat. Light and heat applied for curing are not especially restricted so long as polymerization is performed, but light is preferably used. Lights are not particularly limited so long as the lights are actinic radiations capable of providing the energy to generate polymerization initiating seed polymer, and α-rays, γ-rays, X-rays, UV-rays, visible rays, and electron beams are widely included. Of these rays, UV-rays are preferably used.

When a resin and an organic solvent are contained as the oil phase components, a resin solution is cured to a solid state resin by removing the organic solvent from the oil phase.

As specific methods of eliminating the organic solvent from the oil components, a method of feeding air or inert gas such as nitrogen and drying the organic solvent at the gas-liquid interface (the exhaust drying method), a method of drying by bubbling inert gas according to necessity under reduced pressure (a reduced pressure topping method), a method of using an aqueous solvent that does not dissolve the resin and dissolves the organic solvent in the aqueous phase component on the outside of the oil droplets of the W/O/W emulsion dispersion, and a method of using an organic solvent that is dissolved in the aqueous phase component on the outside of the oil droplets as the organic solvent of the oil phase components of the W/O/W emulsion dispersion are preferably exemplified. It is preferred to perform desolvation by arbitrarily selecting or combining these methods according to the evaporation rate and the solubility in water of the organic solvent to be used.

In connection with the manufacturing method of W/O/W emulsion dispersion, the methods disclosed in JP-A No. 2004-18671 may be referred to besides the above.

A micro-reactor may be used in mixing the material for a crystal, the material for a coat and a dispersion medium in the dispersing process.

The micro-reactors usable in the dispersing process are not especially restricted so long as they are capable of mixing, and known micro-reactors can be used.

For example, a micro-mixer (IMM mixer) (manufactured by Institut fur Mikrotechnik Mainz GmbH, Germany, IMM), the impinging type micro-reactor disclosed in JP-A No. 2005-288254, and the micro-reactor disclosed in JP-A No. 2005-37780 are exemplified.

In the manufacture of the W/O/W emulsion dispersion, it is preferred to use a two liquid mixing type micro-reactor. The above micro-reactors are preferably used as the two liquid mixing type micro-reactor.

The micro-reactor is an apparatus having plural channels of micro-scales, e.g., channels of the widths of several micrometers to several thousand micrometers.

Since the channels of micro-reactors are micro in scale, dimension and flow velocity are both minute and Reynolds' number is 2,300 or less. Accordingly, the apparatus having channels of micro-scales is an apparatus controlled by laminar flow not controlled by turbulent flow as ordinary reaction apparatus.

Here, Reynolds' number (Re) is defined by the following equation.

$$Re=uL/\nu$$

In the equation, u is flow velocity, L is representative length, and ν is coefficient of kinematic viscosity.

When Reynolds' number (Re) is about 2,300 or less, the apparatus is under laminar flow control.

Further, micro-channels indicate channels of micro-scales, and sometimes show the apparatus including micro-channels. Such apparatus are also called micro-reactors as a general term.

The micro-reactor does not utilize turbulent flow as the field of reaction as conventional apparatus but makes it possible to use laminar flow as the field of reaction.

Under the control of laminar flow, when two or more kinds of different liquids are made laminar flows, diffusion by the difference in concentration of the materials in the liquids is caused at the interfacial region of laminar flows including two or more kinds of different liquids. As a result, migration of the materials on the basis of the difference in concentration occurs. The greater the molecular weight of the molecule, the slower is the diffusion velocity.

By utilizing laminar flow as the field of reaction, for example, in the case of mixing two liquids, two liquids are mixed by mutual diffusion at the interfacial region of two liquids. In forming laminar flow of a liquid and gas, it is possible to make diffusion into the gaseous phase and/or the liquid phase through the interface of the liquid and the gas. Further, specific interfacial area is large in the space of the micro-scale, which is advantageous in the case of performing diffusion mixture at the interface.

<Diluting Process>

It is preferred for the manufacturing method of the toner for liquid development of the exemplary embodiment to include a diluting process of diluting the dispersion having dispersed particles formed by a coat containing the material for a crystal inside between the dispersing process and the forming process.

In the diluting process, it is important to perform dilution while maintaining the particles formed by a coat containing the material for a crystal inside manufactured in the dispersing process as they are.

That is, in the dispersion after diluting process, the inside solution of the particles formed by a coat is a high concentration solution of the material for the crystal, and the outside solution of the particles is a low concentration solution of the material for the crystal.

Diluting solvent for use in dilution of the dispersion is not especially restricted but the same solvent as the dispersion medium used in the dispersing process is preferred.

Further, in the diluting process, it is preferred not to apply external stimulation to the particles, and it is more preferred to use a diluting solvent of temperature adjusted to almost the same temperature as that of the dispersion.

<Forming Process>

It is preferred in the manufacturing method of the toner for liquid development of the exemplary embodiment to include a forming process for forming a crystal in the particle having a maximum length longer than the particle diameter of the particle by applying external stimulation.

The external stimulation in the forming process is not especially restricted so long as it is stimulation capable of accelerating the growth of the particle and, for example, temperature change such as cooling and heating, mechanical stimulation such as stirring and shaking, light irradiation, addition of a reaction initiator, variation in electric field, and variation in magnetic field are exemplified. Of these stimulations, temperature change is preferred as external stimulation and temperature change by cooling is more preferred.

As the temperature change, it is preferred to cool the dispersion at 40 to 120° C. to room temperature or lower (25° C. or lower), and it is more preferred to cool the dispersion at 60 to 100° C. to room temperature or lower (25° C. or lower). Temperature is preferably gradually changed, and more preferably the change of 20° C. or lower takes 1 hour or more.

In the forming process, it is sufficient for at least one crystal to have a maximum length longer than the particle diameter of the particle. Further, in the forming process, the crystal formed in the particle may include two or more crystals having a maximum length longer than the particle diameter of the particle and may include one or more crystals having a maximum length not greater than the particle diameter of the particle.

Furthermore, in the forming process, a crystal may be formed outside the particle, but from the point to make isolation of the toner for liquid development of the exemplary embodiment easier, it is preferred that crystals are not formed outside the particle.

It is preferred that the forming process in the manufacturing method of the toner for liquid development of the exemplary embodiment is performed with a micro-reactor.

It is sufficient for the micro-reactor for use in the forming process to be constituted with materials not influenced by raw materials and solvents, and glass, resin and metal are preferably used. Micro-reactors having a built-in temperature controlling system are preferably used.

After the forming process of the manufacturing method of the toner for liquid development of the exemplary embodiment, the obtained toner for liquid development of the exemplary embodiment may be isolated from the dispersion medium and the like according to known methods.

Further, if necessary, in the manufacturing method of the toner for liquid development of the exemplary embodiment, it is preferred to perform drying to remove the dispersion medium from the toner for liquid development of the exemplary embodiment.

An example of the manufacturing method of the toner for liquid development of the exemplary embodiment will be described below with referring to the accompanying Figures.

FIGS. 1A to 1D are schematic representative drawings showing an example of the manufacturing method of the toner particle for liquid development of the exemplary embodiment in the case of using a self-assembled film.

FIG. 1A is a drawing showing an example of the particle formed by a self-assembled film containing the material for a crystal inside formed in the dispersing process.

Particle 10 in FIG. 1A is a particle formed of self-assembled film 12 and contains solution 14 in which the material for crystal is dissolved. Solution 14 is preferably a solution or a super-saturated solution having saturation concentration of 90 to 100%. Solution 16 outside the particle may have the same composition with solution 14, or may be the solution of the material for crystal having the concentration lower than that of solution 14, or may be a liquid not containing the material for crystal, but solution 16 is preferably the solution of the material for crystal having the concentration lower than that of solution 14 or a liquid not containing the material for crystal.

FIG. 1B is a drawing showing an example of the particle formed of the self-assembled film containing the material for crystal in the middle of the forming process.

Particle 10 in FIG. 1B is a particle formed of self-assembled film 12 and contains solution 18 in which the material for crystal is dissolved, and crystal 20 having a maximum length shorter than the particle diameter of the particle 10. Solution 18 is lower in concentration than the concentration of solution 14 in FIG. 1A by the rate of precipitation of crystal 20. Further, liquid 16 on the outside of the particle is the same with liquid 16 in FIG. 1A, but when the composition is the same with solution 14 in FIG. 1A, it is thought that the crystal precipitates even outside the particle.

FIG. 1C is a drawing showing an example of the particle formed of the self-assembled film containing the material for crystal after the forming process.

Particle 10 in FIG. 1C is the particle formed of self-assembled film 12, and contains solution 22 of dissolved material for crystal and crystal 24 having the maximum length longer than the particle diameter of the particle. Crystal 20 having the maximum length shorter than the particle diameter of the particle is also contained in particle 10. Solution 22 is lower in concentration than the concentration of solution 18 in FIG. 1B by the rate of formation of crystal 24. Further, liquid 16 on the outside of the particle is the same with liquid 16 in FIG. 1A, but when the concentration is higher than the concentration of solution 18 in FIG. 1B, it is thought that the crystal precipitates even outside the particle.

FIG. 1D is a drawing showing an example of the particle obtained by drying the particle formed of the self-assembled film containing crystals formed in FIG. 1C.

Particle 26 in FIG. 1D is a particle having self-assembled film 12 on the surface, and contains crystal 24 having the maximum length longer than the particle diameter of the particle. Crystal 20 having the maximum length shorter than the particle diameter of the particle is also contained in particle 26. Self-assembled film 12 wastes the space in the particle by the rate of the removal of solution 22 in FIG. 1C. Further, when components such as binder resin and wax are contained in solution 22, at least a part of them remains in particle 26.

<Liquid Developer>

The liquid developer of the exemplary embodiment contains the toner for liquid development of the exemplary embodiment.

The content of the toner in the liquid developer of the exemplary embodiment is preferably 0.1 to 15% by weight based on the total weight of the liquid developer.

The liquid developer of the exemplary embodiment may be used as a toner together with a toner other than the toner for liquid development of the exemplary embodiment. For example, the liquid developer of the exemplary embodiment may be used with a toner containing particles having a projection of 0 or 1, or with a conventional toner, but it is preferred that the toner for liquid development of the exemplary embodiment accounts for 50% or more of the toner particles, more preferably the toner for liquid development of the exemplary embodiment accounts for 80% or more of the toner particles, and still more preferably the toner for liquid development of the exemplary embodiment accounts for 90% or more of the toner particles.

Further, the liquid developer of the exemplary embodiment may contain, if necessary, known liquid developer components, e.g., a carrier, a charge controlling agent, etc., besides the toner for liquid development of the exemplary embodiment.

<Carrier>

It is preferred for the liquid developer of the exemplary embodiment to contain a carrier.

The carriers are not especially restricted so long as they are carriers generally used as the dispersion medium of liquid developers. However, those having volume intrinsic resisting value of $10^{10}$ Ω·cm or higher are preferably used. Further, those having dielectric constant of 3.5 or more are preferably used.

As such carriers, for example, aliphatic hydrocarbon, alicyclic hydrocarbon, aromatic hydrocarbon, hydrocarbon halide, polysiloxanes, etc., are exemplified. From the points of volatility, safety, toxicity and odor, isoparaffin-based petroleum solvents are suitable.

As such isoparaffin-based petroleum solvents, ISOPAR M, ISOPAR G, ISOPAR H, ISOPAR L, ISOPAR K (manufactured by Exxon Mobil Corporation), and SHELLSOL 71 (manufactured by Shell Chemicals) are exemplified.

The boiling temperature of the carrier is preferably 140 to 320° C. at normal pressure (1 atm), and more preferably 160 to 260° C.

The liquid developer of the exemplary embodiment may contain a charge controlling agent to be contained in a carrier.

As the charge controlling agent to be contained in a carrier, ionic and nonionic charge controlling agents that are present in a carrier liquid and have micell-forming ability are exemplified. Phospholipids, oil-soluble petroleum sulfonate, ionic and nonionic surfactants, block or graft copolymers including a lipophilic portion and a hydrophilic portion, and compounds having polymeric chain skeletons such as cyclic, astral, dendritic polymers (dendrimers) are also exemplified. As especially preferred compounds, compounds that are thermally stable as compounds themselves against the heating condition of the liquid developer and various heat histories, having stabilizing ability of the cation when a charge controlling agent of a salt structure is used, and capable of obtaining stable dispersibility, for example, phospholipids, oil-soluble petroleum sulfonate, and synthetic polymeric compounds that can relatively easily eliminate impurities, for example, block or graft copolymers including a lipophilic portion and a hydrophilic portion are preferably used.

More specifically, phospholipids, e.g., lecithin, cephalin, etc., oil-soluble petroleum sulfonate, e.g., Basic Barium Petronate, Basic Sodium Petronate, Basic Calcium Petronate (manufactured by Witoco Chemical Corp.), polybutylene/succinimide, such as OLOA-1200 (manufactured by Chevron U.S.A. Inc.), etc., are preferably used.

As the block or graft copolymers including a lipophilic portion and a hydrophilic portion, polymers using, as the lipophilic portions, alkyl esters of α,β-ethylenically unsaturated acids as monomers, represented by butadiene, isoprene, acrylic and methacrylic acids are preferably used. As the hydrophilic portions, quaternized trialkylamino polymers, quaternized pyridinium polymers, etc., are favorably used. Further, block copolymers of polyethylene glycol and polypropylene glycol are also preferably used. These block or graft copolymers including a lipophilic portion and a hydrophilic portion have a number average molecular weight of 1,000 to 50,000 as a whole. When these copolymers are block copolymers, the structure may be any of an AB type, an ABA type and a BAB type, and when they are graft copolymers, the structure may be a comb type graft structure. Further, cyclic polymers, e.g., crown ether, macrocyclic amine, polynorbornene, etc., and compounds having polymer chain skeletons such as astral styrene polymer, dendritic polymers (dendrimers) such as polyalkylamide-alpolol may also be used.

As the ionic and nonionic surfactants, the following compounds are more specifically exemplified.

As the nonionic surfactants, polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, fatty acid alkylolamide, etc., are exemplified.

As the anionic surfactants, alkylbenzene sulfonic acid salt, alkylphenyl sulfonic acid salt, alkylnaphthalene sulfonic acid salt, higher fatty acid salt, sulfuric ester salt of higher fatty acid ester, sulfonate of higher fatty acid ester, etc., are exemplified.

As the cationic surfactants, primary, secondary and tertiary amine salts, quaternary ammonium salt, etc., are exemplified.

The amount of these charge controlling agents to be used is preferably 0.01% to 20% by weight based on the weight of the colored resin particles, and especially preferably 0.05% to 10% by weight. When the use amount is in the above range, sufficient charge controlling effect is obtained, and proper electrical conductance of the liquid developer is secured. The content of the charge controlling agent to be used based on the weight of the carrier is preferably 0.01% to 10% by weight, and more preferably 0.05% to 1% by weight. When the amount is in the above range, sufficient charge controlling effect is obtained, and proper electrical conductance of the liquid developer is secured.

For revealing sufficient charge controlling effect with a small addition amount, it is also preferred to use these charge controlling agents in combination with the charge controlling agents in the toner particles as described above.

Further, polymer particles and inorganic particles may further be dispersed in the liquid developer of the exemplary embodiment for the purpose of controlling the physical properties of the liquid developer. Furthermore, for the purpose of prevention of deterioration due to heat, oxidation by humidity, and viscosity increase by radical chain of the carrier and charge controlling agent, various kinds of additives may be dispersed or dissolved in the liquid of the liquid developer.

As the antioxidants, 2,2'-methylenebis(4-methyl-6-t-butylphenol), 1,1,3-tris(2-methyl-4-hydroxy-5-t-butylphenyl) butane, dilauryl thiodipropionate, triphenyl phosphite, etc., are specifically exemplified.

As radical polymerization inhibitors, 1,4-dihydroxybenzene, 1,4-naphthoquinone, diphenylpicrylhydrazyl, N-(3-N-oxyanilino-1,3-dimethyl-butylidene)aniline oxide, etc., are specifically exemplified.

(Image-Forming Method)

It is sufficient that the image-forming method of the exemplary embodiment is an image-forming method using the liquid developer of the exemplary embodiment. The image-forming method of the exemplary embodiment preferably includes a latent image-forming process of forming an electrostatic latent image on the surface of an image holding member, a developing process of developing the electrostatic latent image formed on the surface of the image holding member with a liquid developer to form a developed image (a toner image, a colored resin particle image), a transfer process of transferring the developed image formed on the surface of the image holding member to the surface of a transfer-receiving member, and a fixing process of fixing the developed image transferred to the surface of the transfer-receiving member, and the liquid developer of the exemplary embodiment is preferably used as the liquid developer.

As the image-forming method of the exemplary embodiment, it is preferred to prepare a developer with the specific toner as described above, to form and develop an electrostatic image with the developer and ordinary electrophotographic copier, electrostatically transfer the obtained developed image to a transfer-receiving paper and fix the developed image with a heating roller fixing apparatus set at a constant temperature to form a copied image.

It is also preferred that the image-forming method of the exemplary embodiment includes an eliminating process for eliminating at least a part of the carrier in the developed image between the developing process and the transfer process.

Elimination of the carrier in the developed image is not especially restricted and known methods may be used. Specifically, a method of evaporating the carrier by heating, a method of compressing the developed image with a reverse roller rotating in the reverse direction to the traveling direction of the image holding member, a method of squeezing the carrier by applying an air knife to the developed image, and a method of squeezing the carrier by corona discharge are exemplified.

The electrostatic image developer (electrostatic image developing toner) of the exemplary embodiment can be used in an ordinary electrostatic image developing method (an electrophotographic method). The image-forming method of the exemplary embodiment specifically includes an electrostatic latent image-forming process, an image-forming process, a transfer process, and a cleaning process. Each process itself is an ordinary process, and is disclosed in JP-A Nos. 56-40868 and 49-91231. Incidentally, the image-forming process of the exemplary embodiment may be performed by using image-forming apparatus, such as copiers and facsimile terminal equipments.

The electrostatic latent image-forming process is a process of forming an electrostatic latent image on an image holding member. The image-forming process is a process of forming a developed image by developing the electrostatic latent image with a developer layer on a developer holding member. The developer layer is not especially restricted so long as it contains the liquid developer of the exemplary embodiment. The transfer process is a process of transferring the developed image onto a transfer-receiving member. The cleaning process is a process of eliminating the liquid developer remaining on the image holding member.

It is preferred for the image-forming method of the exemplary embodiment to further include a recycling process. The recycling process is a process of shifting the liquid developer collected in the cleaning process to the developer layer, or a process of re-preparing the collected liquid developer and shifting to the developer layer. Alternatively, the recycling process may be applied to a recycling system of collecting the liquid developer simultaneously with development by omitting the cleaning process.

Further, as the process of forming a latent image on the image holding member in the image-forming method of the exemplary embodiment, known methods used in electrophotographic or electrostatic recording method may be adopted.

The image holding member may be not only an electrophotographic photoreceptor but also a dielectric substance.

Also in connection with the process of developing the latent image formed in the above process, a known method of using the liquid developer is adopted, but when a carrier medium that is solid at ordinary temperature is used as the liquid developer, it is preferred to perform development while heating the liquid developer.

(Image-Forming Apparatus)

It is preferred for the image-forming apparatus of the invention to include an image holding member, a latent image-forming unit to form a latent image on the surface of the image holding member, a developing unit to develop the latent image with the liquid developer of the exemplary embodiment to form a toner image, a transfer unit to transfer the toner image from the image holding member to a transfer-receiving member, and a fixing unit to fix the toner image on the transfer-receiving member.

Further, it is preferred that the image-forming apparatus of the exemplary embodiment has, as the latent image-forming unit, a charging unit to charge the surface of the image holding member, and an exposure unit to form an electrostatic latent image by exposing according to image data the surface of the latent image holding member charged by the charging unit. In the transfer unit, transfer may be performed two or more times by using an intermediate transfer member.

As the image holding member and each unit, the constitution described above in each process of the image-forming method may be preferably used.

As each unit described above, various units known in image-forming apparatus may be used. The image-forming apparatus for use in the exemplary embodiment may include units and apparatus other than the constitutions described above. The image-forming apparatus for use in the exemplary embodiment may perform plural of the above units at the same time.

It is preferred that the image-forming apparatus of the exemplary embodiment to further have an eliminating unit of eliminating at least a part of the carrier in the developed image.

As the eliminating unit of the carrier in the developed image, the above described units are exemplified.

(Liquid Developer Cartridge and Process Cartridge)

The liquid developer cartridge of the exemplary embodiment is a liquid developer cartridge containing the liquid developer of the exemplary embodiment.

The process cartridge of the exemplary embodiment is a process cartridge containing the liquid developer of the exemplary embodiment, which is preferably a process cartridge equipped with at least one unit selected from the group consisting of an image holding member, a charging unit to charge the surface of the image holding member, a developing unit to develop an electrostatic latent image with the liquid developer of the exemplary embodiment to form a toner image, and a cleaning unit to eliminate the toner remaining on the surface of the electrostatic latent image holding member.

The liquid developer cartridge of the invention is preferably attachable to and detachable from the image-forming apparatus. That is, in the image-forming apparatus having the constitution to which the liquid developer cartridge is attachable and from which the liquid developer cartridge is detachable, the liquid developer cartridge of the exemplary embodiment housing the liquid developer of the exemplary embodiment is preferably used.

The process cartridge of the exemplary embodiment is preferably attachable to and detachable from the image-forming apparatus.

Further, the process cartridge of the exemplary embodiment may contain other members such as a destaticizer, if necessary.

The liquid developer cartridge of the exemplary embodiment and the process cartridge of the exemplary embodiment may arbitrarily adopt known constitutions.

The invention will be described in further detail with reference to examples of the exemplary embodiment, but the invention is by no means restricted thereto. In the examples "parts" means "parts by weight" unless otherwise indicated.

Example 1

Dipalmitoyl phosphatidyl choline (5 g) and 5 μg of phosphatidyl glycerol are dissolved in a mixed solvent of chloroform and methanol (chloroform/methanol=98/2), the solvent is evaporated by nitrogen gas flow, and the reaction product is dried and solidified to form Film A.

Film A is put in 5 mL of a saturated aqueous solution of Chrome Yellow 7G (manufactured by BASF Japan Ltd.) heated at 70° C. After leaving to stand for 10 minutes, the reaction solution is diluted five times with water of 70° C. Spherical particles having a diameter of about 3 μm encapsulated with a self-assembled film are observed by observation with the dark field of an optical microscope.

Micro-reactor A having Peltier temperature controllers in various places, channel length of 1,000 mm and channel width of 0.8 mm is manufactured. The dispersion of the particles is gradually cooled with micro-reactor A from 70° C. to room temperature over 5 hours. By observation with the dark field of the optical microscope, it is observed that projections by crystal growth of Chrome Yellow 7G are formed on the particles having a particle diameter of about 2 μm encapsulated with the self-assembled film. After that, the dispersion is separated by centrifugal separation (1,000 rpm, 10 min.), and dispersed in ISOPAR G (manufactured by Exxon Mobil Corporation) so as to reach solid content of 15% by weight to prepare liquid developer B.

Example 2

Styrene (1 g), 0.5 g of vinyl acetate, 1 g of 818SX (condensed decaglycerol ricinoleate, manufactured by Taiyo Chemical Industry Co., Ltd.), and 0.02 g of methylbenzoyl benzoate are dissolved in 100 mL of toluene. The solution is maintained at 70° C., 30 mL of saturated solution of Lake Red barium salt (70° C.) is added thereto, and the solution is emulsified with a rotary homogenizer (5,000 rpm) to obtain a W/O emulsion.

The emulsion is supplied from supply port 1 of a two liquid mixing type micro-reactor heated at 70° C., and 0.2% decaglycerol monolaurate and a 2% polyvinyl alcohol solution are supplied from another supply port. A W/O/W emulsion is grown by this operation at the mixing part of two solutions. Microcapsules are manufactured by polymerization reaction by means of ultraviolet irradiation with a high pressure mercury lamp at the downstream side of the mixing part. Microcapsules having a diameter of about 3 μm are observed by observation with an optical microscope.

The dispersion of the particles is gradually cooled with micro-reactor A from 70° C. to room temperature over 5 hours. By observation with the optical microscope, it is observed that projections by crystal growth of Lake Red barium salt are formed on the microcapsules having a diameter of about 2 μm. After that, dry air is blown to a micro-reactor (a gas-liquid mixing type, manufactured by IMM) to eliminate toluene in the particles. The microcapsules are separated by centrifugal separation (1,000 rpm, 10 min.), and dispersed in ISOPAR G (manufactured by Exxon Mobil Corporation) so as to reach solid content of 15% by weight to prepare liquid developer C.

Example 3

Film A is put in 5 mL of a saturated toluene solution of tyrosine containing a coloring agent and quinacrine heated at 70° C. After leaving to stand for 10 minutes, the reaction solution is diluted five times with toluene heated at 70° C. Spherical particles having a diameter of about 3 μm encapsulated with a self-assembled film are observed by observation with the dark field of an optical microscope.

The dispersion of the particles is gradually cooled with micro-reactor A from 70° C. to room temperature over 5 hours. By observation with the optical microscope, it is observed that projections by crystal growth of quinacrine are formed on the microcapsules having a diameter of about 2 μm. After that, toluene in the particles is eliminated by concentration treatment with a micro-reactor (a gas-liquid mixing type, manufactured by IMM). The microcapsules are separated by centrifugal separation (1,000 rpm, 10 min.), and dispersed in ISOPAR G (manufactured by Exxon Mobil Corporation) so as to reach solid content of 15% by weight to prepare liquid developer D.

Comparative Example 1

Film A is put in 5 mL of a saturated toluene solution of quinacrine heated at 70° C. After leaving to stand for 10 minutes, the reaction solution is diluted five times with toluene heated at 70° C. Spherical particles having a diameter of about 3 μm encapsulated with a self-assembled film are observed by observation with the dark field of an optical microscope.

The dispersion of the particles is gradually cooled with micro-reactor A from 70° C. to room temperature over 5 hours. Spherical particles having a diameter of about 3 μm encapsulated with a self-assembled film are observed by observation with the dark field of an optical microscope. Spherical particles having a diameter of about 3 μm encapsulated with a self-assembled film are observed by observation with the dark field of an optical microscope. After that, the dispersion is separated by centrifugal separation (1,000 rpm, 10 min.), and dispersed in ISOPAR G (manufactured by Exxon Mobil Corporation) so as to reach solid content of 15% by weight to prepare liquid developer E.

Comparative Example 2

Liquid developer F is manufactured in the same manner as in Example 1 in JP-B No. 5-87825 (The term "JP-B" as used herein refers to an "examined Japanese patent publication").

<Evaluation Method of Liquid Developer)

(Evaluation of Preservation Stability)

The condition of the obtained liquid developer is observed after leaving to stand for one month.

All of the liquid developers are precipitated to the bottoms of the sample bottles. Each of the bottles is lightly shaken from this state.

TABLE 1

| Example No. | Liquid Developer | Condition after Shaking |
|---|---|---|
| Example 1 | B | Good dispersion condition |
| Example 2 | C | Good dispersion condition |
| Example 3 | D | Good dispersion condition |
| Comparative Example 1 | E | Not dispersed |
| Comparative Example 2 | F | Good dispersion condition |

(Evaluation of Image)

A line of the width of 0.5 mm is printed on commercially available coat paper with each liquid developer by applying to the modified type of an electrostatic plotter (CE-3436, manufactured by VERSATEC). After binarization of the image by means of a microscope (VHX-100, manufactured by Keyence Corporation), the blank areas are computed.

A: Blank area is less than 1%.

B: Blank area is 1% or more and less than 10%.

C: Blank area is 10% or more and less than 20%.

D: Blank area is 20% or more.

TABLE 2

| Example No. | Liquid Developer | Evaluation of Image Quality |
|---|---|---|
| Example 1 | B | A |
| Example 2 | C | A |
| Example 3 | D | A |
| Comparative Example 1 | E | B |
| Comparative Example 2 | F | C |

In the toner for liquid development in Comparative Example 1, the toner precipitates and flocculates during long term preservation of the toner dispersion. As a result, re-dispersibility is deteriorated and preservation stability lowers. Contrary to this, the toner for liquid development in Comparative Example 2 has tentacle-like projections on the surface of the toner particles, which projections prevents flocculation of toner particles to each other. However, the toner for liquid development in Comparative Example 2 is manufactured by a manufacturing method of crushing the foam toner precursor material, accordingly the particle size distribution of the toner is wide, and particle diameters are also in a wide range. This fact is thought to be the cause of the image quality reduction.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A toner particle for liquid development, comprising:

a plurality of projections;

a coat above at least a part of a surface of the toner particle; and a crystal contained inside the toner particle that forms at least one of the plurality of projections.

2. The toner particle for liquid development according to claim 1, wherein the coat is a self-assembled film or a resin.

3. The method for manufacturing the toner particle for liquid development according to claim 2, wherein the external stimulation is temperature change.

4. The method for manufacturing the toner particle for liquid development according to claim 2, wherein a microreactor is used in at least one of the manufacturing of the dispersion and the forming of the crystal.

5. The toner particle for liquid development according to claim 1, wherein about 20% to 100% of a surface area of the toner particle is coated with the coat.

6. The toner particle for liquid development according to claim 1, wherein the coat is solid at an ordinary temperature of 25° C.

7. The toner particle for liquid development according to claim 1, wherein the crystal is solid at an ordinary temperature of 25° C.

8. The toner particle for liquid development according to claim 1, wherein the crystal is monocrystal.

9. The toner particle for liquid development according to claim 1, wherein a maximum length of a crystal which has the longest maximum length out of the crystal contained inside the toner particle is about 20% to 100% longer than a particle diameter of the toner particle.

10. The toner particle for liquid development according to claim 1, wherein an aspect ratio of a crystal which has the longest maximum length out of the crystal contained inside the toner particle is from about 5 to about 200.

11. The toner particle for liquid development according to claim 1, wherein the crystal is a material having a function as a coloring agent.

12. A method for manufacturing the toner particle for liquid development according to claim 1, the method comprising:

manufacturing a dispersion in which particles are dispersed in a dispersion medium, each of the particles formed by a coat containing a material for crystal; and forming the crystal inside of each of the particles by applying external stimulation, the formed crystal having a maximum length longer than a particle diameter of each of the particles.

13. A liquid developer, comprising:

the toner particle for liquid development according to claim 1.

14. A liquid developer cartridge, comprising:

the liquid developer according to claim 13.

15. A process cartridge, comprising:

the liquid developer according to claim 13.

16. An image-forming apparatus, comprising:

an image holding member;

a latent image-forming unit that forms a latent image on a surface of the image holding member;

a developing unit that forms a toner image by developing the latent image with the liquid developer according to claim 13;

a transfer unit that transfers the toner image to a transfer-receiving material from the image holding member; and a fixing unit that fixes the toner image on the transfer-receiving material.

17. The toner particle for liquid development according to claim 1, wherein a part of the crystal that is contained inside the toner particle protrudes from a surface of the coat.

18. The toner particle for liquid development according to claim 1, wherein a maximum length of a crystal which has the longest maximum length out of the crystal contained inside the toner particle is 50% or more longer than a particle diameter of the toner particle.

* * * * *